US007610888B2

(12) United States Patent
Rogers et al.

(10) Patent No.: US 7,610,888 B2
(45) Date of Patent: Nov. 3, 2009

(54) NON-GUIDED TAPPET AND FUEL INJECTOR USING SAME

(75) Inventors: Eric L. Rogers, El Paso, IL (US); Stephen R. Lewis, Chillicothe, IL (US); Dana R. Coldren, Secor, IL (US)

(73) Assignee: Caterpillar Inc., Peoria, IL (US)

( * ) Notice: Subject to any disclaimer, the term of this patent is extended or adjusted under 35 U.S.C. 154(b) by 17 days.

(21) Appl. No.: 12/082,017

(22) Filed: Apr. 8, 2008

(65) Prior Publication Data

US 2009/0250531 A1 Oct. 8, 2009

(51) Int. Cl.
*F02M 47/02* (2006.01)
*F01L 1/14* (2006.01)

(52) U.S. Cl. ..... 123/90.48; 239/88; 74/569

(58) Field of Classification Search ..... 123/445, 123/446, 90.48; 239/88–96; 74/569
See application file for complete search history.

(56) References Cited

U.S. PATENT DOCUMENTS 3,859,973 A * 1/1975 Dreisin ..... 123/502
3,951,046 A * 4/1976 Lochmann et al. ..... 92/113
4,355,546 A * 10/1982 Moloney et al. ..... 74/569
4,519,299 A * 5/1985 Moloney ..... 92/129
5,407,131 A 4/1995 Maley et al.
5,520,155 A * 5/1996 Hefler ..... 123/509
6,209,798 B1 * 4/2001 Martin et al. ..... 239/88
6,607,149 B2 * 8/2003 Smith et al. ..... 239/585.1
6,628,186 B1 * 9/2003 Wolfges ..... 335/220
6,684,859 B2 * 2/2004 Bredesen et al. ..... 123/470
6,688,536 B2 2/2004 Coldren et al.
6,976,474 B1 12/2005 Coldren et al.
2001/0015383 A1 * 8/2001 Coldren et al. ..... 239/88
2003/0192510 A1 * 10/2003 Bredesen et al. ..... 123/470

* cited by examiner

*Primary Examiner*—Thomas N Moulis
(74) *Attorney, Agent, or Firm*—Liell & McNeil

(57) ABSTRACT

A fuel injector includes an injector body having an internal surface and an external surface. A tappet assembly includes a non-guided tappet and a plunger assembly, and is mounted on the injector body. The tappet assembly is movable with respect to the injector body a displacement distance between an advanced position and an extended position. A portion of the plunger assembly is slidably guided along the internal surface of the injector body, while the non-guided tappet is free of contact with both the internal surface and the external surface of the injector body in the advanced and extended positions. The tappet assembly may be prevented from moving beyond the extended position using a snap ring positioned within a retention opening of the fuel injector body.

19 Claims, 2 Drawing Sheets

NON-GUIDED TAPPET AND FUEL INJECTOR USING SAME

TECHNICAL FIELD

The present disclosure relates generally to a non-guided tappet for a fuel injector, and more particularly to a non-guided tappet that is free of contact with a fuel injector body during movement of a tappet assembly.

BACKGROUND

Conventional mechanically actuated fuel injectors include a tappet assembly having a tappet and a plunger that, typically, are mechanically coupled to one another. A rocker arm assembly moves with each rotation of an engine camshaft, moving the tappet, and thus the plunger, downward. The plunger, disposed within a plunger bore of the fuel injector, pressurizes fuel during this downward stroke, and is retracted by a spring during fuel injection events. The spring, which is always compressed, also maintains the tappet in contact with the rocker arm assembly throughout the operation of the system.

Typically, these fuel injectors include a guided tappet, as shown in U.S. Pat. No. 6,607,149. Specifically, the tappet may include a sleeve portion that telescopically receives a portion of the fuel injector body. This arrangement is designed to maintain alignment of the tappet with a centerline axis of the fuel injector and, therefore, reduce side loading of the components. While performance of these fuel injectors may prove acceptable, there remains a risk of seizure or failure between the interacting components. For example, the high operating temperatures and pressures may cause component expansion, which may distort the clearance between the tappet sleeve and the external guiding surface of the fuel injector body. In addition, contaminants may break down the fluid film between the internal surface of the tappet sleeve and the external surface of the fuel injector body, thus causing wear or eventual failure of the moving components. Further considerations may include the added costs of external or, alternatively, internal guiding features.

Oftentimes, these guided tappets are prevented from accidentally disconnecting from the fuel injector body during transport using a cylindrical pin that engages a portion of the tappet assembly. Since transport may include shipping and handling of the fuel injector, it is possible for side forces occurring during these stages to cause the tappet assembly to become misaligned with a centerline axis of the fuel injector, especially since the pin engages only one side of the tappet assembly. In addition, since transport occurs without the substantial lubrication that exists after installation, it is possible for a misalignment to cause scuffing, seizure, or, at the very least, difficulties during installation.

The present disclosure is directed to one or more of the problems set forth above.

SUMMARY OF THE DISCLOSURE

In one aspect, a fuel injector includes an injector body having an internal surface and an external surface. A tappet assembly includes a non-guided tappet and a plunger assembly, and is mounted on the injector body. The tappet assembly is movable, with respect to the injector body, between an advanced position and an extended position. A portion of the plunger assembly is slidably guided along the internal surface of the injector body, while the non-guided tappet is free of contact with both the internal surface and the external surface of the injector body in the advanced and extended positions.

In another aspect, a method of assembling a fuel injector includes a step of positioning a tappet assembly between an advanced position and an extended position with respect to a fuel injector body. The tappet assembly includes a non-guided tappet and a plunger assembly. The tappet assembly is prevented from moving beyond the extended position using a snap ring positioned within a retention opening of an internal surface of the fuel injector body.

In yet another aspect, a method of transporting a fuel injector includes a step of maintaining an assembled configuration of a tappet assembly and a fuel injector body using a retention member having a retention force. The retention member is oriented about a centerline axis of the fuel injector, and is free of contact with a non-guided tappet of the tappet assembly. Further, the tappet assembly is urged toward alignment with the centerline axis using the retention force.

DETAILED DESCRIPTION

Figure 1:
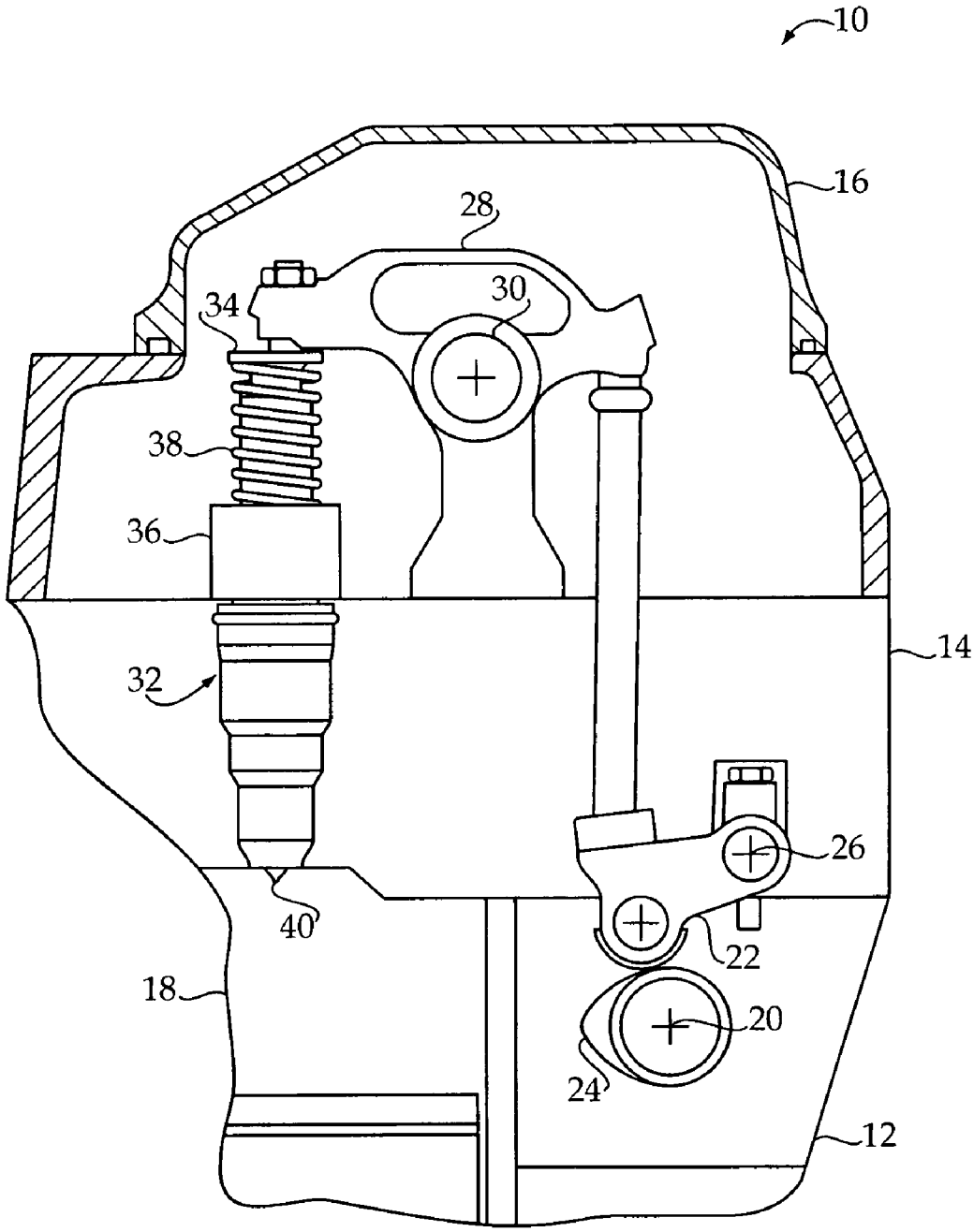
FIG. 1 is a sectioned side diagrammatic view of an engine having a fuel injector installed therein, according to the present disclosure.

An exemplary embodiment of an engine 10, illustrated and described as an internal combustion engine, is shown in FIG. 1. The engine 10 generally includes a cylinder block 12, a cylinder head 14 attached to the cylinder block 12, and a cover 16 attached to the cylinder head 14. The engine 10 further includes a plurality of cylinder bores, such as a cylinder bore 18, positioned within the cylinder block 12. According to one embodiment, the engine 10 may include six equally spaced, in-line cylinder bores. However, the engine 10 or, more specifically, the cylinder block 12 may be of any other conventional design and may include any number of cylinder bores.

The engine 10 also includes a camshaft 20 rotatably positioned within the cylinder block 12, and in contact with one or more lifter assemblies, such as a lifter assembly 22. With each cycle of the engine 10, a lobe 24 of the camshaft 20 moves the lifter assembly 22 upward about a lifter shaft 26. The lifter assembly 22 acts upon one or more rocker arm assemblies, such as a rocker arm assembly 28, which is mounted to pivot about a rocker arm shaft 30. According to one embodiment, the number of lifter assemblies, rocker arm assemblies, and fuel injectors may correspond to the number of cylinder bores within the engine 10. Overhead cam configurations also fall within the intended scope of this disclosure.

As shown, a portion of the rocker arm assembly 28 is in contact with a fuel injector 32. Specifically, the rocker arm assembly 28 is in contact with a non-guided tappet 34 that is mated to a fuel injector body 36 of the fuel injector 32. A compression spring 38 has one end in contact with the fuel injector body 36, and its other end in contact with the non-guided tappet 34. The compression spring 38 biases the non-guided tappet 34 away from the fuel injector body 36, such that the rocker arm assembly 28 maintains contact with the non-guided tappet 34 in a conventional manner. With each cycle of the engine 10, the non-guided tappet 34 is driven downward to move a plunger, discussed later in greater detail, positioned within the fuel injector body 36. The downward stroke of the plunger within the fuel injector 32 pressurizes fuel so that fuel commences to spray out of a nozzle outlet 40 and into cylinder bore 18.

Figure 2:
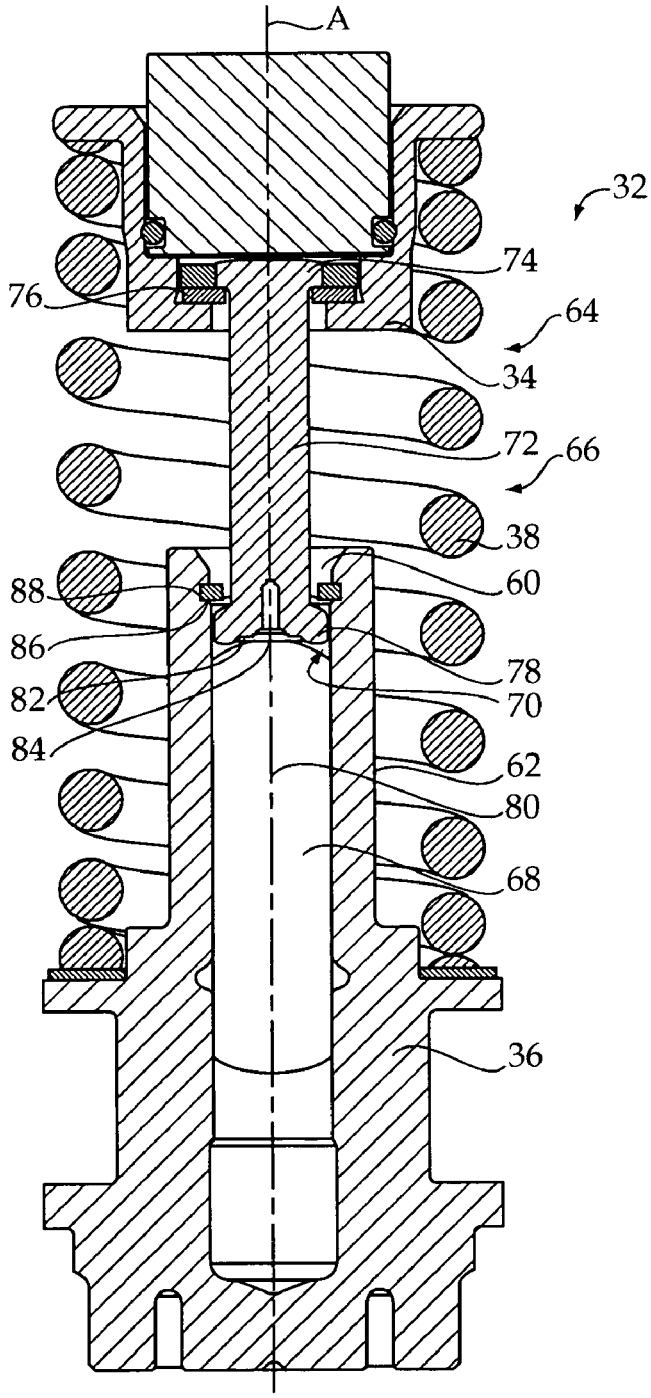
FIG. 2 is a sectioned side diagrammatic view of an upper portion of the fuel injector of FIG. 1, according to one embodiment of the present disclosure.

Referring now to FIG. 2, there is shown a sectioned side view of a top portion of the fuel injector 32. Specifically, the top portion of the fuel injector body 36 is shown having an internal surface 60 and an external surface 62. A tappet assembly 64 is mounted on the fuel injector body 36 and includes the non-guided tappet 34 and a plunger assembly 66. A portion of the plunger assembly 66 is slidably guided along the internal surface 60 of the fuel injector body 36. According to one embodiment, the plunger assembly 66 includes a free-floating plunger 68 disposed within a plunger bore 70 defined by the internal surface 60 of the fuel injector body 36. A "free-floating" plunger, as used herein, may include any plunger that is not mechanically connected to the non-guided tappet 34, allowing these components to move uncoupled.

The plunger assembly 66 may also include a movable pushrod 72 having a first end 74 attached to the non-guided tappet 34 using a retaining clip 76, or any other known retention means. A second end 78 of the movable pushrod 72 is configured to contact a first end 80 of the free-floating plunger 68. As shown, the movable pushrod 72 may include a substantially I-shaped cross section. According to a specific embodiment, the second end 78 of the movable pushrod 72 may include a concave contact surface 82 that engages a convex contact surface 84 of the free-floating plunger 68. Although plunger assembly 66 is shown having two separate components, it should be appreciated that the plunger assembly 66 may include one integral component having a portion disposed within the plunger bore 70 and a portion thereof attached to non-guided tappet 34.

According to the exemplary embodiment, the fuel injector 32 also includes a retention member 86 positioned within a retention opening 88 defined by the internal surface 60 of the fuel injector 36. The retention member 86, as shown, is configured to engage the second end 78 of the movable pushrod 72, and may include a snap ring or any other known retention means. It may be desirable to orient the retention member 86 about a centerline axis A of the fuel injector 32, such that a retention force of the retention member 86 urges the tappet assembly 64 toward alignment with the centerline axis A during its movement. It should be appreciated that the concave contact surface 82 of the movable pushrod 72 and the convex contact surface 84 of the free-floating plunger 68 may also serve to urge the tappet assembly 64 toward alignment with centerline axis A.

The tappet assembly 64 is movable with respect to the fuel injector body 36 a displacement distance between an advanced position and an extended position. Specifically, when the rocker arm assembly 28 (FIG. 1) is in its downward position, it exerts a downward force on the tappet assembly 64 that moves the tappet assembly 64 toward its advanced position against the action of the compression spring 38. When the non-guided tappet 34 is moved toward the advanced position, it pushes the plunger assembly 66, i.e., the movable pushrod 72 and the free-floating plunger 68, toward its advanced position in a corresponding manner. During this downward stroke, the free-floating plunger 68 acts as a means to pressurize fuel within a fuel pressurization chamber defined by the fuel injector body 36.

When the rocker arm assembly 28 returns to its upward position, the force on the tappet assembly 64 is relieved so that the non-guided tappet 34 and movable pushrod 72 are returned to an installed retracted position, as shown, under the action of compression spring 38. It should be appreciated by those skilled in the art that the installed retracted position is between the advanced position and the extended position of the tappet assembly 64. The second end 78 of movable pushrod 72 remains out of contact with retention member 86 throughout its motion after installation within the engine 10. Because the free-floating plunger 68 is not mechanically coupled to the movable pushrod 72, the plunger 68 is returned to the retracted position by fuel pressure from a fuel source via a fuel inlet that is defined by the fuel injector body 36.

As shown, the non-guided tappet 34 of the tappet assembly 64 is free of contact with the fuel injector body 36. Specifically, the non-guided tappet 34, as described herein, is free of contact with both of the internal surface 60 and the external surface 62 of the fuel injector body 36 in all of the advanced, extended, and installed retracted positions of the components of the tappet assembly 64. A "non-guided" tappet, as used herein, may describe any tappet that does not include internal and/or external guiding features, such as, for example, side walls that may engage or receive any portion of the fuel injector body 36.

The fuel injector 32 may be assembled by first positioning the tappet assembly 64 between the advanced position and the extended position, with respect to the fuel injector body 36. Specifically, the free-floating plunger 68 of the plunger assembly 66 may be positioned within the plunger bore 70 of the fuel injector body 36, such that the free-floating plunger 68 is positioned into the plunger bore 70 past the retention opening 88. The first end 74 of the movable pushrod 72 of the plunger assembly 66 may then be positioned within the plunger bore 70, such that the first end 74 is also positioned past the retention opening 88. As previously described, the second end 78 of the movable pushrod 72 is linked with the non-guided tappet 34, such as with a retaining clip 76. As such, the compression spring 38, which biases the tappet assembly 64 toward the extended position, may be positioned between the non-guided tappet 34 and the fuel injector body 36 prior to positioning the first end 74 of the movable pushrod 72 within the plunger bore 70.

The tappet assembly 64 is prevented from moving beyond the extended position using the retention member 86. Specifically, the free-floating plunger 68 and the first end 74 of the movable pushrod 72 are retained within the plunger bore 70 using retention member 86. The retention member 86, which may include a snap ring, is positioned within the retention opening 88 of the internal surface 60 of the fuel injector body 36. According to one embodiment, a retention member engagement tool (not shown) may engage ends of a snap ring to contract the snap ring, such that the outer diameter of the snap ring is less than a diameter of the internal surface 60 of the fuel injector body 36. The snap ring may then be slid into the plunger bore 70 and released into the retention opening 88. In its released configuration, the snap ring has an inner diameter that is less than a diameter of the first end 74 of the movable pushrod 72. Therefore, the snap ring, or other similar retention member 86, prevents the tappet assembly 64 from disconnecting from the fuel injector body 36, such as during shipping and handling prior to installation.

After assembly, and prior to installation, the fuel injector 32 may be transported with a reduced risk that the tappet assembly 64, or any component thereof, will accidentally disconnect from the fuel injector body 36. Specifically, the assembled configuration of the tappet assembly 64 and the fuel injector body 36 is maintained using the retention member 86. The retention member 86, which provides a retention force, is preferably oriented about the centerline axis A of the fuel injector 32, such that the retention force urges the tappet assembly 64 toward alignment with the centerline axis A. It should be appreciated that "transport," as used herein, may broadly refer to the time and/or location of the fuel injector 32 between manufacture and installation. Therefore, transport may include, for example, shipping, handling, and storage, such as at a warehouse.

During installation, the retention member 86 may assist in setting the timing height of the fuel injector 32. For example, the height of the fuel injector 32 at its extended position, realized during shipping, may be near the height of the fuel injector 32 at its installed retracted position. After installation of the fuel injector 32, using conventional means, an adjustment feature of the rocker arm assembly 28 may be actuated to set the proper installed retracted position of the fuel injector 32. Since the fuel injector 32 at these two positions may include only a minimal height difference, the installation process may be quicker than in alternative configurations.

INDUSTRIAL APPLICABILITY

The non-guided tappet of the present disclosure may find application in a variety of fuel injectors. Although a diesel engine is described, it should be appreciated that a fuel injector, including the non-guided tappet described herein, may be used in a variety of internal combustion engines. Further, the fuel injector, as described, may be specifically applicable to applications in which mechanically actuated or tappet driven fuel injectors are used.

Referring now to FIGS. 1 and 2, a typical injection event of an engine 10 will be described. Prior to the injection event, a lifter assembly 22 is in its downward position, such that a rocker arm assembly 28 is in an upward position exerting a minimal amount of force on a tappet assembly 64. The tappet assembly 64, according to one embodiment, includes a non-guided tappet 34 and a plunger assembly 66. The plunger assembly 66, according to this exemplary embodiment, includes a free-floating plunger 68 and a movable pushrod 72. A compression spring 38 biases all of these components of the tappet assembly 64 toward an installed retracted position.

The injection event is initiated when the lifter assembly 22 moves upward about a lifter shaft 26, in response to a rotation of an engine camshaft 20. Lifter assembly 22 then acts upon the rocker arm assembly 28, and pivots the same downward about a rocker arm shaft 30. When the rocker arm assembly 28 is in its downward position, it exerts a downward force on the tappet assembly 64 that moves the tappet assembly 64 toward its advanced position against the action of the compression spring 38. When the non-guided tappet 34 is moved toward the advanced position, it pushes the plunger assembly 66, i.e., the movable pushrod 72 and the free-floating plunger 68, toward its advanced position in a corresponding manner. During this downward stroke, the free-floating plunger 68 pressurizes fuel according to conventional means.

When the rocker arm assembly 28 returns to its upward position, the force on the tappet assembly 64 is relieved so that the non-guided tappet 34 and movable pushrod 72 are returned to an installed retracted position, as shown in FIG. 2, under the action of compression spring 38. Because the free-floating plunger 68 is not mechanically coupled to the movable pushrod 72, the plunger 68 may be returned to the retracted position by fuel pressure, as should be appreciated by those skilled in the art.

The non-guided tappet 34 of the present disclosure has a number of advantages over conventional tappets. For example, because the non-guided tappet 34 is free of contact with the fuel injector body 36 throughout an injection event, scuffing and seizure that may result between those components is greatly reduced. Specifically, since the non-guided tappet 34 does not include any internal and/or external guiding features that may engage or receive a portion of the fuel injector body 36, extreme operating temperatures and pressures that may cause component distortion are no longer an issue with respect to those components. In addition, known concerns of a break down of a fluid film between a conventional guided tappet and a fuel injector body are rendered irrelevant, since the components, according to the present disclosure, are no longer in contact. Further, significant cost benefits may be realized by eliminating the costly internal and/or external guiding features of conventional tappets.

The guiding feature typically provided by a guided tappet may, at least in part, be replaced by a retention member 86 that serves to align the tappet assembly 64. Because a retention force of the retention member 86 urges the tappet assembly 64 toward alignment with a centerline axis A of the fuel injector 32, side forces exerted on the components of the tappet assembly 64 may be reduced. This may be especially useful in avoiding misalignments that can develop due to settling during transport between manufacture and installation, such as may commonly occur with a cylindrical pin retention member. More specifically, the retention member 86 may reduce a misaligned movement of the movable pushrod 72, which may contribute to scuffing or seizure of the pushrod 72. The retention member 86, as should be appreciated, also reduces the possibility of the fuel injector 32 becoming completely disconnected during shipping and handling prior to installation.

An additional advantage of the fuel injector 32, and non-guided tappet 34 thereof, includes a cost savings resulting from a reduction in materials needed to manufacture the components. Specifically, since the non-guided tappet 34 does not include the guiding features of conventional tappets, less material is required to manufacture the fuel injector 32.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A fuel injector, comprising:

an injector body having an internal surface and an external surface;

a tappet assembly mounted on the injector body and movable with respect to the injector body a displacement distance between an advanced position and an extended position, wherein the tappet assembly includes a non-guided tappet and a plunger assembly;

wherein a portion of the plunger assembly is slidably guided along the internal surface of the injector body; and wherein the non-guided tappet is free of contact with both the internal surface and the external surface of the injector body in the advanced and extended positions.

2. The fuel injector of claim 1, wherein the plunger assembly includes a free-floating plunger.

3. The fuel injector of claim 2, wherein the plunger assembly further includes a movable pushrod having a first end attached to the non-guided tappet and a second end configured to contact a first end of the free-floating plunger.

4. The fuel injector of claim 3, wherein the movable pushrod includes a substantially I-shaped cross section.

5. The fuel injector of claim 4, wherein the second end of the movable pushrod includes a concave contact surface, and wherein the first end of the free-floating plunger includes a convex contact surface.

6. The fuel injector of claim 3, further including a retention member positioned within a retention opening defined by the internal surface of the injector body and configured to engage the second end of the movable pushrod.

7. The fuel injector of claim 6, wherein the retention member includes a snap ring.

8. The fuel injector of claim 7, further including a spring positioned to bias the tappet assembly toward the extended position.

9. The fuel injector of claim 1, wherein the tappet assembly further includes an installed retracted position that is between the advanced position and the extended position.

10. A method of assembling a fuel injector, comprising:

positioning a tappet assembly between an advanced position and an extended position with respect to a fuel injector body, wherein the tappet assembly includes a non-guided tappet and a plunger assembly; and preventing the tappet assembly from moving beyond the extended position using a snap ring positioned within a retention opening of an internal surface of the fuel injector body.

11. The method of claim 10, wherein the positioning step includes positioning a free-floating plunger of the plunger assembly within a plunger bore of the fuel injector body.

12. The method of claim 11, wherein the positioning step further includes positioning a first end of a movable pushrod of the plunger assembly within the plunger bore.

13. The method of claim 12, further including linking a second end of the movable pushrod with the non-guided tappet, wherein the non-guided tappet is free of contact with the fuel injector body in both the advanced and extended positions.

14. The method of claim 13, further including positioning a spring between the non-guided tappet and the fuel injector body for biasing the tappet assembly toward the extended position.

15. A method of transporting a fuel injector, comprising:

maintaining an assembled configuration of a tappet assembly and a fuel injector body using a retention member having a retention force;

orienting the retention member about a centerline axis of the fuel injector, wherein the retention member is free of contact with a non-guided tappet of the tappet assembly; and urging the tappet assembly toward alignment with the centerline axis using the retention force.

16. The method of claim 15, wherein the maintaining step includes retaining a portion of a plunger assembly within a plunger bore of the fuel injector body using a snap ring positioned within a retention opening of the fuel injector body.

17. The method of claim 16, wherein the maintaining step further includes retaining a free-floating plunger and a first end of a movable pushrod within the plunger bore using the snap ring.

18. The method of claim 17, wherein the maintaining step further includes retaining a second end of the movable pushrod within the non-guided tappet using a second retention member, wherein the non-guided tappet is free of contact with the fuel injector body.

19. The method of claim 18, further including biasing the non-guided tappet away from the fuel injector body using a spring.

* * * * *